US009893426B2

(12) United States Patent
Lapushin

(10) Patent No.: US 9,893,426 B2
(45) Date of Patent: Feb. 13, 2018

(54) PCB EMBEDDED RADIATOR ANTENNA WITH EXPOSED TUNING STUB

(71) Applicant: Verizon Patent and Licensing Inc., Arlington, VA (US)

(72) Inventor: Semyon Lapushin, Tucker, GA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 43 days.

(21) Appl. No.: 14/922,598

(22) Filed: Oct. 26, 2015

(65) Prior Publication Data

US 2017/0117620 A1 Apr. 27, 2017

(51) Int. Cl.
*H01Q 9/04* (2006.01)
*H01Q 1/24* (2006.01)
*H01Q 1/38* (2006.01)

(52) U.S. Cl.
CPC ..... *H01Q 9/0421* (2013.01); *H01Q 1/243* (2013.01); *H01Q 1/38* (2013.01); *H01Q 9/0442* (2013.01)

(58) Field of Classification Search
CPC ..... H01Q 1/38; H01Q 9/0414; H01Q 9/0421; H01Q 9/0442
See application file for complete search history.

(56) References Cited

U.S. PATENT DOCUMENTS

| | | | | |
|---|---|---|---|---|
| 7,372,373 | B2 | 5/2008 | Borisov et al. | |
| 7,439,840 | B2 | 10/2008 | Carastro et al. | |
| 2002/0122007 | A1* | 9/2002 | Jansen | H01Q 1/243 343/702 |
| 2007/0096992 | A1* | 5/2007 | Fujii | H01Q 9/0414 343/700 MS |

* cited by examiner

*Primary Examiner* — Robert Karacsony

(57) ABSTRACT

A printed circuit board (PCB) antenna includes a main antenna radiator element embedded within substrate material of a multilayered PCB such that the main antenna radiator element is formed on, or within, a different substrate layer than other components of the PCB antenna. The PCB antenna includes a first PCB substrate, and a first conductive pattern formed on the first PCB substrate, where the first conductive pattern comprises an antenna radiator. The PCB antenna includes a second PCB substrate that is affixed to a first side of the first PCB substrate, and includes a second conductive pattern formed on the second PCB substrate, where the second conductive pattern comprises an antenna ground connection, and an antenna feed connection. The antenna ground connection and the antenna feed connect, through substrate material, to a first end of the antenna radiator of the first PCB substrate.

20 Claims, 9 Drawing Sheets

PCB EMBEDDED RADIATOR ANTENNA WITH EXPOSED TUNING STUB

BACKGROUND

Printed Planar Inverted-F antennas (PIFAs) are antennas that resemble an inverted letter "F" formed on a printed circuit board (PCB). A PIFA has a ground trace and a feed trace formed in a single plane with a resonant antenna radiator conductive trace on the PCB. The antenna radiator conductive trace of the PIFA has a certain length that determines the resonant frequency of the antenna. A position of the feed trace on the antenna radiator conductive trace can be used to control the input impedance of the PIFA antenna. Typically, the PIFA is placed on the edge of the PCB, with the area on the PCB surrounding the PIFA being copper-free to prevent any impact on the frequency response of the PIFA.

DETAILED DESCRIPTION OF THE PREFERRED EMBODIMENTS

The following detailed description refers to the accompanying drawings. The same reference numbers in different drawings may identify the same or similar elements. The following detailed description does not limit the invention.

A multilayered printed circuit board (PCB) antenna, as described herein, includes a main antenna radiator trace embedded within the layers of the multilayered PCB and formed on, or within, a separate substrate layer of the multilayered PCB from the antenna ground trace and the antenna feed trace, and on, or within, a separate substrate layer from the antenna tuning stub trace. The PCB antenna is formed on, or within, multiple different layers of a PCB, with one PCB layer including the antenna feed trace and the antenna ground trace formed on, or within, a first substrate layer comprising a dielectric material, and another PCB layer including the main antenna radiator trace formed on, or within, a different, second substrate layer comprising a dielectric material. In one embodiment, the antenna tuning stub trace may be formed on, or within, the same PCB substrate layer as the antenna ground trace and the antenna feed trace. In another embodiment, the antenna tuning stub trace may be formed on, or within, a substrate layer of the multi-layer PCB that is different than the substrate layer containing the antenna radiator trace, or different than the substrate layer containing the antenna ground trace and the antenna feed trace. The multiple layers of the PCB may be affixed to one another using known techniques for forming multi-layered PCBs. The effect of the main antenna radiator trace being embedded within, and sandwiched between, the dielectric PCB substrate layers of the multi-layered PCB is a reduction in the length of the main antenna radiator trace needed for a particular desired resonant frequency, as compared to a conventional antenna. Therefore, embedding the antenna radiator within substrate layers of a multi-layered PCB, on a separate PCB layer from the antenna ground trace and the antenna feed trace or on a same PCB layer, as described herein, reduces the space required for the antenna for a given resonant frequency. In one implementation described herein, the antenna tuning stub trace may be formed on, or within, an outside substrate layer of the multilayer PCB to facilitate the fine tuning of the antenna via adjustment of the length of the antenna tuning stub. When the antenna tuning stub is formed on the outside substrate layer (e.g., on substrate 116 in FIG. 1), the conductive trace of the antenna tuning stub may be formed on an underside of the substrate layer (i.e., facing downwards on the underside of substrate 116 in FIG. 1) and exposed to air to allow easy access to the antenna tuning stub.

Figure 1:
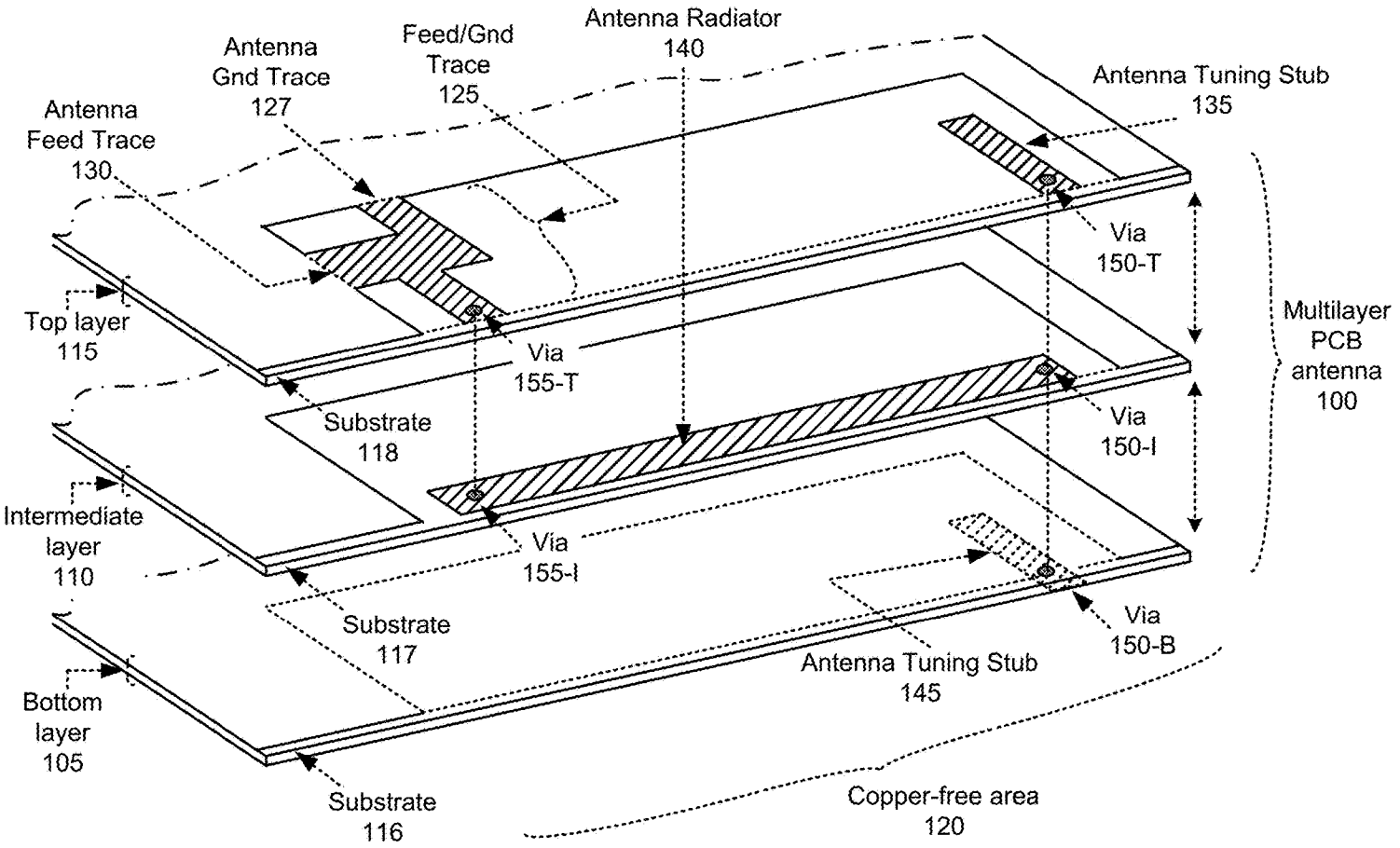
FIG. 1 depicts an "exploded" three dimensional view of a multilayer PCB antenna.
Figures 2A, 2B, 2C:
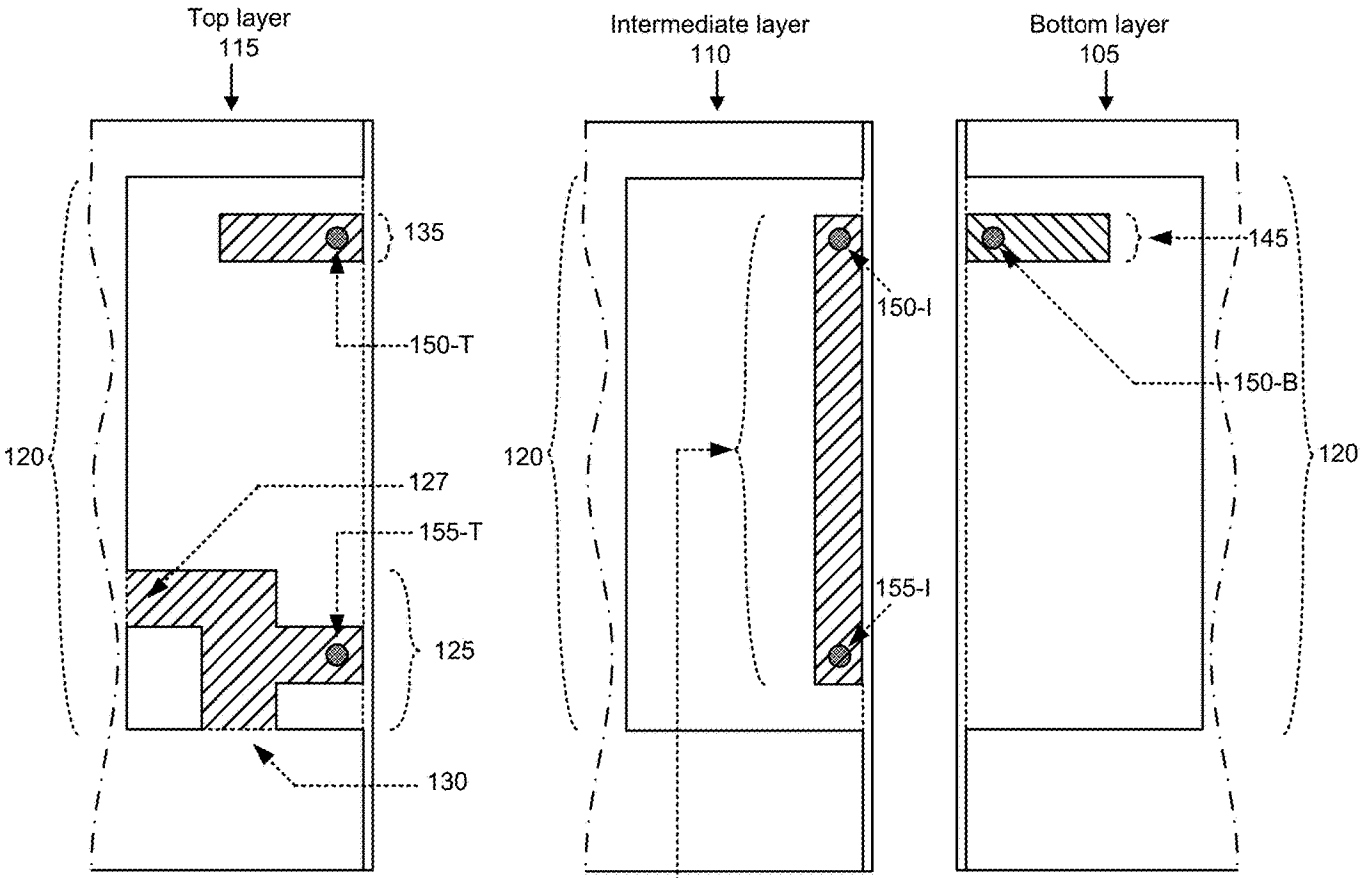
FIGS. 2A, 2B and 2C depict a two-dimensional "overhead" view of each layer of the multilayer PCB antenna of FIG. 1.
Figure 3A:
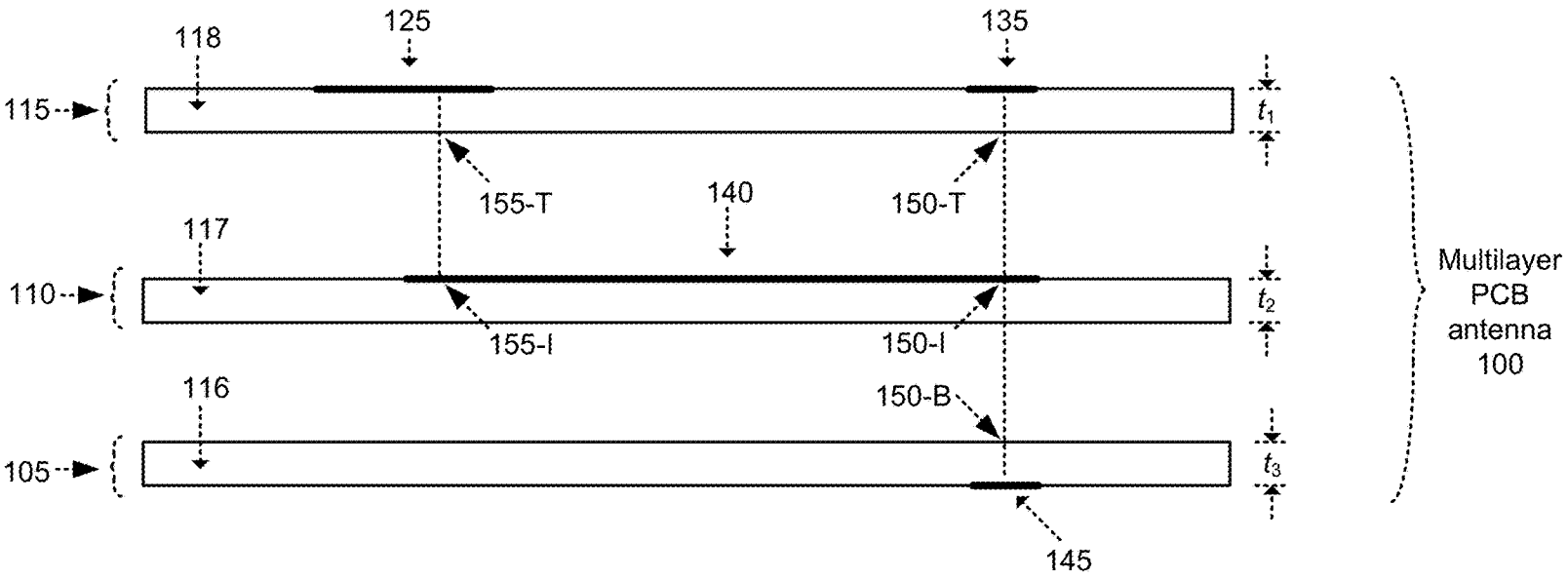
FIG. 3A depicts an "exploded" two-dimensional side view of the multilayer PCB antenna of FIG. 1.
Figure 3B:
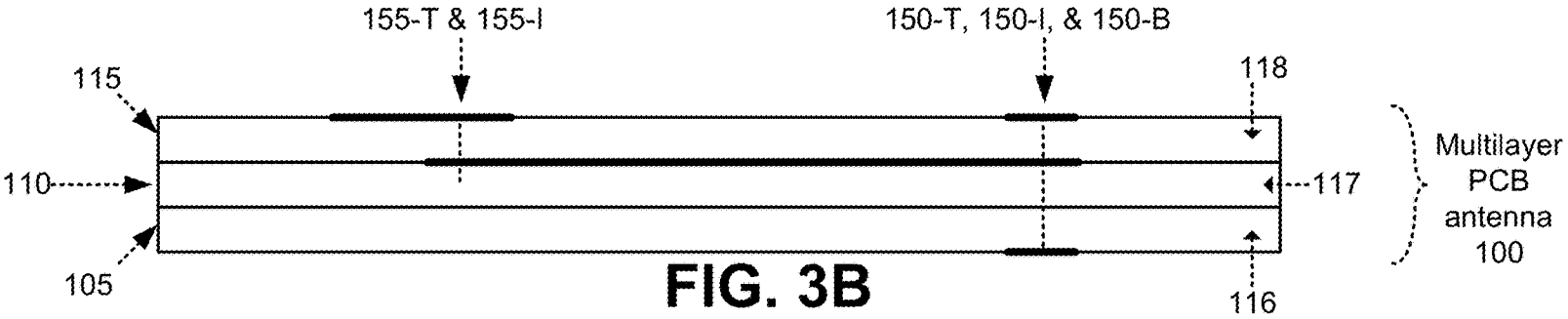
FIG. 3B depicts a two-dimensional side view of the multiplayer PCB antenna of FIG. 1, where the multiple layers are depicted as affixed to one another.

FIGS. 1, 2A-2C, 3A and 3B are diagrams that depict a multilayered PCB antenna in which a main radiator element of the antenna is formed on, or within, a separate substrate layer of the multilayered PCB from the antenna tuning stub, and from the feed and ground traces of the antenna. FIG. 1 depicts an "exploded" three dimensional view of multilayer PCB antenna 100, FIGS. 2A, 2B and 2C depict a two-dimensional "overhead" view of each layer of multilayer PCB antenna 100, FIG. 3A depicts an "exploded" two-dimensional side view of multilayer PCB antenna 100, and FIG. 3B depicts a two-dimensional side view of multiplayer PCB antenna 100 where the multiple layers are depicted as affixed to one another. A "layer" or "PCB layer," as referred to herein, includes a single layer of substrate material, and the conductive traces of components of an antenna formed upon, or within, that layer of substrate material. A "substrate" or "substrate layer," as referred to herein, includes a single layer of substrate material, comprising a dielectric material, but does not include the conductive traces, or other circuit components, formed on or within the layer of substrate material.

As shown in FIG. 1, multilayer PCB antenna 100 includes multiple PCB layers affixed to one another in a stack of PCB layers, such as bottom layer 105, intermediate layer 110 and top layer 115. Each of layers 105, 110 and 115 includes a copper-free area 120 that is free of conductive traces including copper or other conductive elements, or other circuit components, except conductive traces of the antenna itself. On each of layers 105, 110 and 115, the regions surrounding copper-free area 120 include conductive traces associated with other circuitry (not shown), and components (not shown) of other circuitry connected to, or in the vicinity of, the antenna of multilayer PCB 100. As shown in FIG. 1, PCB layer 105 may include a substrate 116, PCB layer 110 may include a substrate 117, and PCB layer 115 may include a substrate 118. Substrate layers 116, 117 and 118 may be formed, using known techniques, from dielectric materials such as, for example, fiberglass (e.g., FR4), plastic, epoxy, or phenolics. Bottom layer 105, depicted in FIG. 1, may be optional such that multilayer PCB antenna 100 only includes top layer 115 and intermediate layer 110, where top layer 115 includes the antenna tuning stub. Alternatively, the antenna tuning stub formed on, or within, bottom layer 105 (described below) may be optional, with bottom layer 105 existing within the multiple PCB layers but not including the antenna tuning stub. In the particular embodiment depicted in FIG. 1, bottom layer 105 represents an outside layer of antenna 100, such that the underside is exposed (e.g., to air) and no further PCB layers are affixed to, and beneath, bottom layer 105.

As depicted in FIGS. 1 and 2A, copper-free area 120 of top layer 115 of PCB antenna 100 includes a feed/ground trace conductive pattern 125 and, optionally, an antenna tuning stub 135. The view of top layer 115 in FIG. 2A corresponds to a downward view from above top layer 115 in FIG. 1 (i.e., looking downwards, in FIG. 1, from the top of FIG. 1 towards the bottom of FIG. 1). Feed/ground trace conductive pattern 125 further includes an antenna ground trace 127 and an antenna feed trace 130 and, as shown, includes a via 155-T formed to extend through feed/ground trace 125, and through substrate 118 of top layer 115 to intermediate layer 110. Via 155-T includes, for example, a circular hole formed through substrate 118 of top layer 115 such that feed/ground trace 125 can be connected to antenna radiator 140 of intermediate layer 110 by a wire, or by conductive solder. Antenna ground trace 127 includes a conductive trace pattern that connects to electrical ground through the circuitry in the regions surrounding copper-free area 120. Antenna feed trace 130 includes a conductive trace pattern that connects to other circuitry components (not shown), in the regions surrounding copper-free area 120, that provide the output radio-frequency (RF) signals to be transmitted via the PCB antenna 100, or which process input RF signals received via the PCB antenna 100. Optional antenna tuning stub 135 includes a conductive trace pattern having a tuning length (described further with respect to FIGS. 4-6 below) that may be adjusted to change the frequency response (e.g., the resonant frequency) of PCB antenna 100. Antenna tuning stub 135 additionally includes a via 150-T that extends through tuning stub 135 and through substrate 118 of top layer 115 to intermediate layer 110. Via 150-T includes, for example, a circular hole formed through substrate 118 of top layer 115 such that antenna tuning stub 135 can be connected to antenna radiator 140 of intermediate layer 110 by a wire, or by conductive solder. The configuration and dimensions of antenna tuning stub 135, vias 150-T and 155-T, and feed/ground trace conductive pattern 125 are described in further detail below with respect to FIG. 4.

As further depicted in FIG. 1 and FIG. 2B, copper-free area 120 of intermediate layer 110 includes a main antenna radiator conductive trace pattern 140. The view of intermediate layer 110 in FIG. 2B corresponds to a downward view from above intermediate layer 110 in FIG. 1 (i.e., looking downwards, in FIG. 1, from the top of FIG. 1 towards the bottom of FIG. 1). As shown, main antenna radiator 140 includes a rectangular trace pattern that extends along an edge of intermediate layer 110 of PCB antenna 100. Antenna radiator 140 includes a via 155-I formed through one end of antenna radiator 140, and a via 150-I formed through an opposite end of antenna radiator 140. Via 155-I includes, for example, a circular hole formed through substrate 117 of intermediate layer 110 such that the one end of antenna radiator 140 can be connected to feed/ground trace 125 of top layer 115 by a wire, or by conductive solder. Via 150-I includes, for example, a circular hole formed through substrate 117 of intermediate layer 110 such that the opposite end of antenna radiator 140 can be connected to antenna tuning stub 145 of bottom layer 105, or to antenna tuning stub 135 of top layer 115 through via 150-T, by a wire, or by conductive solder. The configuration and dimensions of antenna radiator trace 140, and vias 150-I and 155-I, are described in further detail below with respect to FIG. 5. As an alternative to the disposition of feed/ground trace 125, and antenna radiator 140, shown in FIGS. 1, 2A and 2B, antenna feed/ground trace 125 may be formed on an underside of substrate 118 (an underside as shown in FIG. 1 looking from the top of FIG. 1 towards a bottom of FIG. 1) and antenna radiator 140 may be formed on an underside of substrate 117 (looking from the top of FIG. 1 towards a bottom of FIG. 1), with antenna feed/ground trace 125 connecting to antenna radiator 140 through via 155-I and substrate 117.

As depicted in FIG. 1 and FIG. 2C, copper-free area 120 of bottom layer 105 may include an antenna tuning stub 145. The view of bottom layer 105 in FIG. 2C corresponds to an upwards view from below bottom layer 105 in FIG. 1 (i.e., looking upwards, in FIG. 1, from the bottom of FIG. 1 towards the top of FIG. 1). Antenna tuning stub 145 includes a conductive trace pattern having a length (described further with respect to FIGS. 4-6 below) that may be adjusted to change the frequency response (e.g., the resonant frequency) of PCB antenna 100. Antenna tuning stub 145 additionally includes a via 150-B that extends through tuning stub 145 and through substrate 116 of bottom layer 105. Via 150-B includes, for example, a circular hole formed through substrate 116 of bottom layer 105 such that antenna tuning stub 145 can be connected to antenna radiator 140 (through via 150-I) of intermediate layer 110 by a wire, or by conductive solder. The configuration and dimensions of antenna tuning stub 145, and via 150-B, are described in further detail below with respect to FIG. 6. As an alternative to the disposition of antenna tuning stub 145 shown in FIGS. 1 and 2C, antenna tuning stub 145 may be formed upon an underside of substrate 117 of layer 110 (i.e., on an opposite of substrate layer 117 from antenna radiator 140) with via 150-I of layer 110 being used to connect one end of antenna radiator 140 to antenna tuning stub 145 through substrate layer 117. In such an implementation, layer 105 may not exist in multilayer PCB antenna 100 such that layer 110 is the bottom layer, and antenna tuning stub 145 is exposed on the underside of substrate layer 117.

FIGS. 3A and 3B depict side views of multilayer PCB antenna 100 that show the alignment between the vias of the different layers of PCB antenna 100. Referring to the "exploded" side view of PCB antenna 100 shown in FIG. 3A, top layer 115 includes feed/ground trace 125 and antenna tuning stub 135 formed on substrate layer 118. Feed/ground trace 125 and antenna tuning stub 135 may each include a pattern of conductive material (e.g., copper) formed on an upper surface of substrate layer 118. Substrate layer 118 may have a thickness $t_1$ ranging from about 0.25 mm to about 1.0 mm, and may be composed of a substrate material having a dielectric constant ranging from about 2.6 to about 6.2. In one exemplary implementation, the dielectric constant of substrate layer 118 may be 4.6. However, in other implementations, any value for the dielectric constant of substrate layer 118 may be used (i.e., less than 2.6, or greater than 6.2). The substrate material of substrate layer 118 may include, for example, fiberglass (e.g., FR4), plastic, epoxy, or phenolics.

Intermediate layer 110 includes antenna radiator trace 140 formed on substrate layer 117. Antenna radiator 140 includes a pattern of conductive material (e.g., copper) formed on an upper surface of substrate layer 117, where substrate layer 117 may have a thickness $t_2$ ranging from about 0.25 mm to about 1.0 mm, and may be composed of a substrate material having a dielectric constant ranging from about 2.6 to about 6.2. In one exemplary implementation, the dielectric constant of substrate layer 117 may be 4.6. However, in other implementations, any value for the dielectric constant of substrate layer 117 may be used (i.e., less than 2.6, or greater than 6.2). The substrate material of substrate layer 117 may include, for example, fiberglass (e.g., FR4), plastic, epoxy, or phenolics.

Bottom layer 105 may include optional antenna tuning stub 145 formed on substrate layer 116. Antenna tuning stub 145 includes a pattern of conductive material (e.g., copper) formed on a lower surface of substrate layer 116, where substrate layer 116 may have a thickness $t_3$ ranging from about 0.25 mm to about 1.0 mm, and may be composed of a substrate material having a dielectric constant ranging from about 2.6 to about 6.2. Formation of antenna tuning stub 145 on the lower surface of substrate layer 116, thus, exposes antenna tuning stub 145 for adjustment of a length of the tuning stub. In one exemplary implementation, the dielectric constant of substrate layer 116 may be 4.6. However, in other implementations, any value for the dielectric constant of substrate layer 116 may be used (i.e., less than 2.6, or greater than 6.2). The substrate material of substrate layer 116 may include, for example, fiberglass (e.g., FR4), plastic, epoxy, or phenolics. Other types of substrate material, than those described, may be used for substrate layers 116, 117 and 118. The substrate material of the different substrate layers 116, 117 and 118 may be composed of the same, or of different, substrate materials (e.g., the substrate material of substrate layer 116 may be different than the substrate material of substrate layer 117, etc.). Additionally, different types of conductive material, other than copper, may be used for forming the conductive traces on the substrate layers of PCB layers 105, 110 and/or 115 of multilayer PCB antenna 100. The respective thicknesses $t_1$, $t_2$ and $t_3$ of substrate layers 116, 117 and 118 may, in some implementations, be approximately at least ten times the thickness of the conductive traces that form antenna ground trace 127, antenna feed trace 130, antenna radiator 140, antenna tubing stub 135 and antenna tuning stub 145.

As depicted with a dashed alignment line (left side, FIG. 3A) extending between layers 115 and 110, and a dashed alignment line (right side, FIG. 3A) extending between layers 115, 110 and 105, the layers of PCB antenna 100 are affixed to one another such that certain vias of the different layers "line-up" with another in a vertical direction. For example, via 155-T of top layer 115 lines up with via 155-I of intermediate layer 110 such that a conductive wire, or conductive solder, may be placed, or formed, through the vias to interconnect feed/ground trace 125 with antenna radiator trace 140. As another example, via 150-T of top layer 115 lines up with via 150-I of intermediate layer 110, and via 150-I lines up with via 150-B of bottom layer 105 such a conductive wire, or conductive solder, may be placed, or formed, through the vias to interconnect antenna tuning stub 135 to antenna radiator trace 140, or antenna radiator 140 to antenna tuning stub 145.

FIG. 3B depicts layers 105, 110 and 115 of PCB antenna 100 affixed to one another in a completely formed multilayer PCB antenna assembly. As shown with a dashed alignment line (left side, FIG. 3B), vias 155-T and 155-I of respective layers 115 and 110 line up to permit an electrical interconnection between feed/ground trace 125 and one end of antenna radiator trace 140. As further shown with a dashed alignment line (right side, FIG. 3B), vias 150-T, 150-I and 150-B line up to permit an electrical interconnection between antenna tuning stub trace 135, and an opposite end of antenna radiator trace 140, or optionally between antenna radiator trace 140 and antenna tuning stub trace 145.

Figure 4:
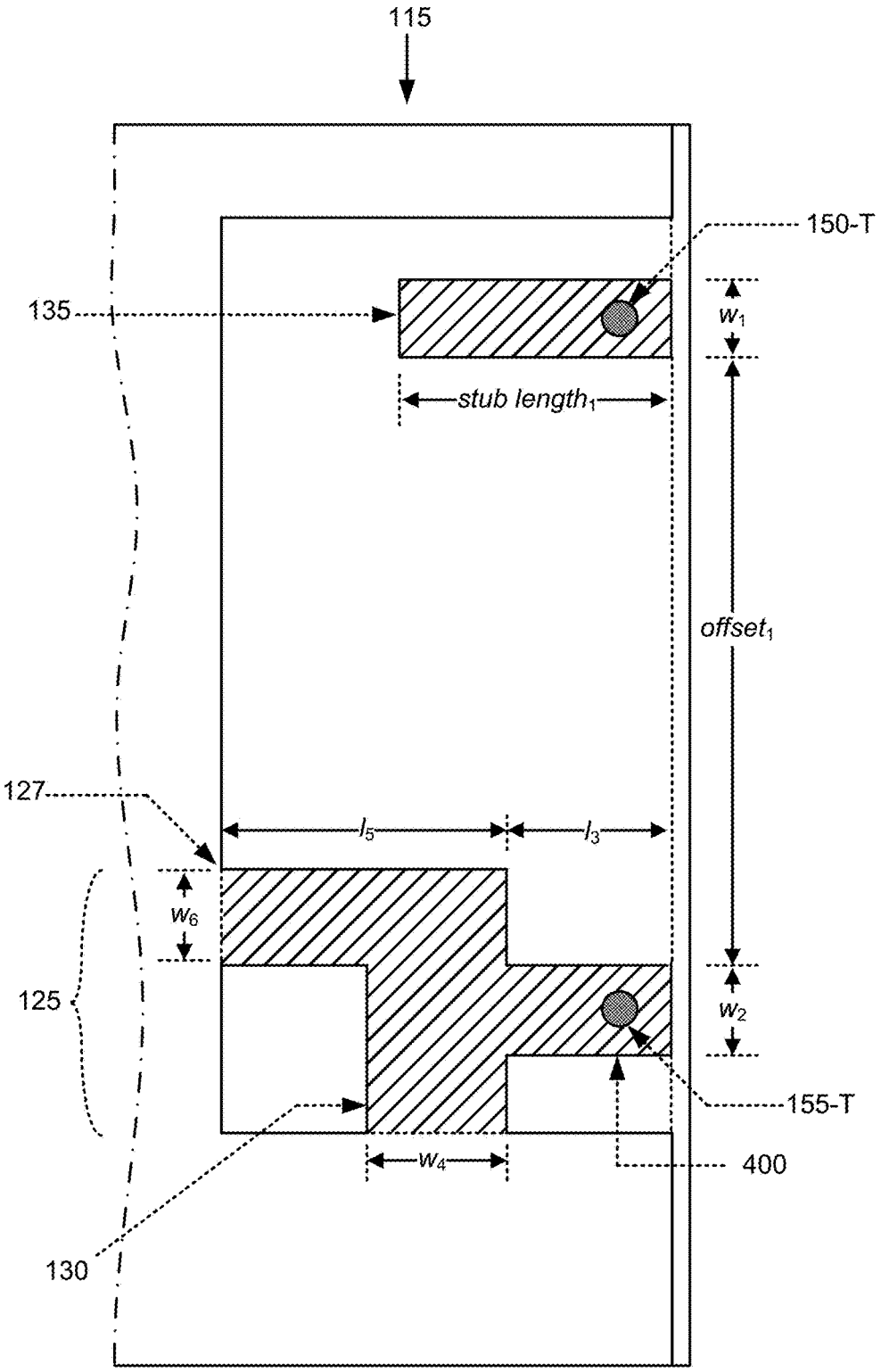
FIGS. 4-6 depict dimensional parameters associated with the various components of the PCB antenna of FIG. 1.
Figure 5:
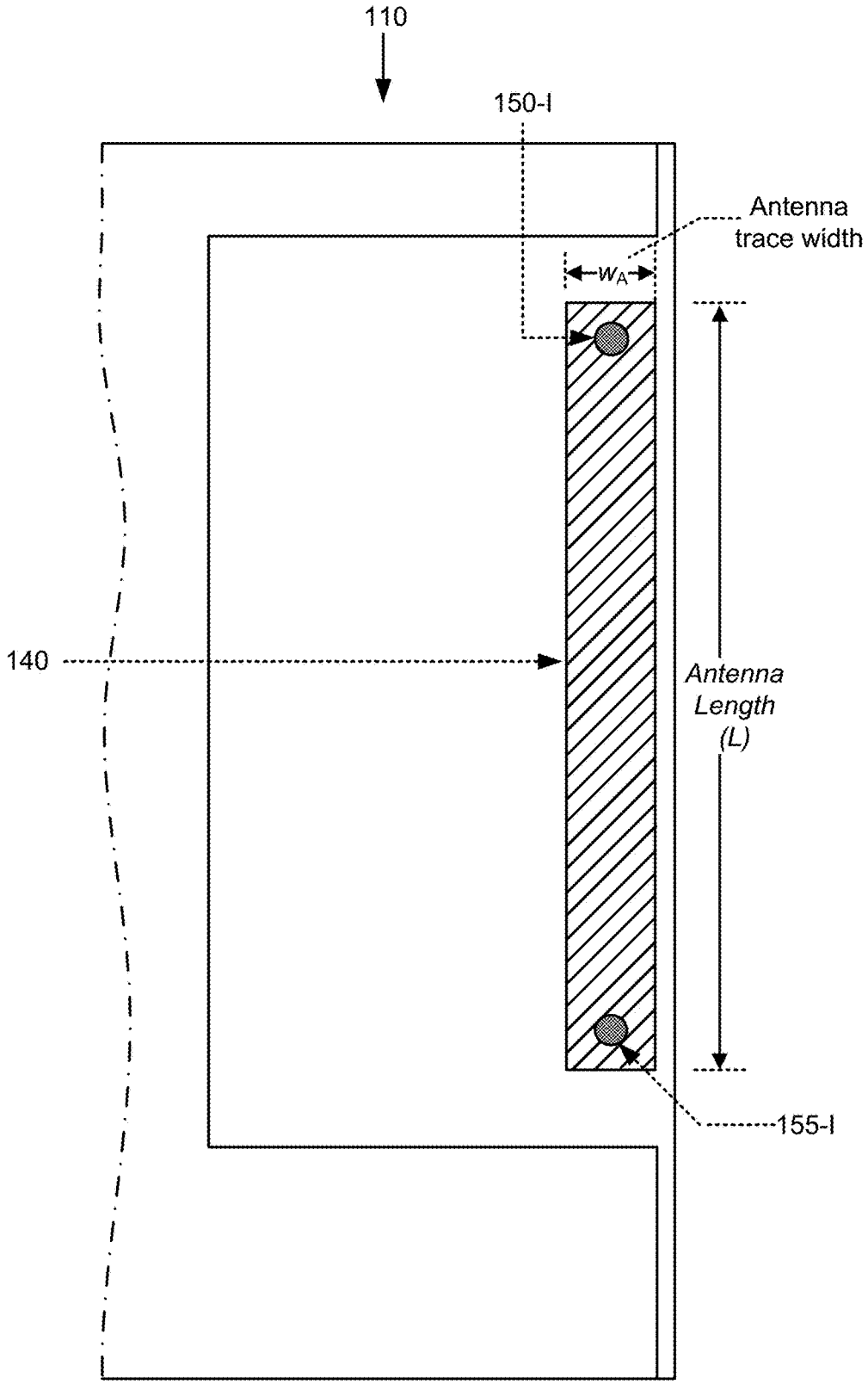
Figure 6:
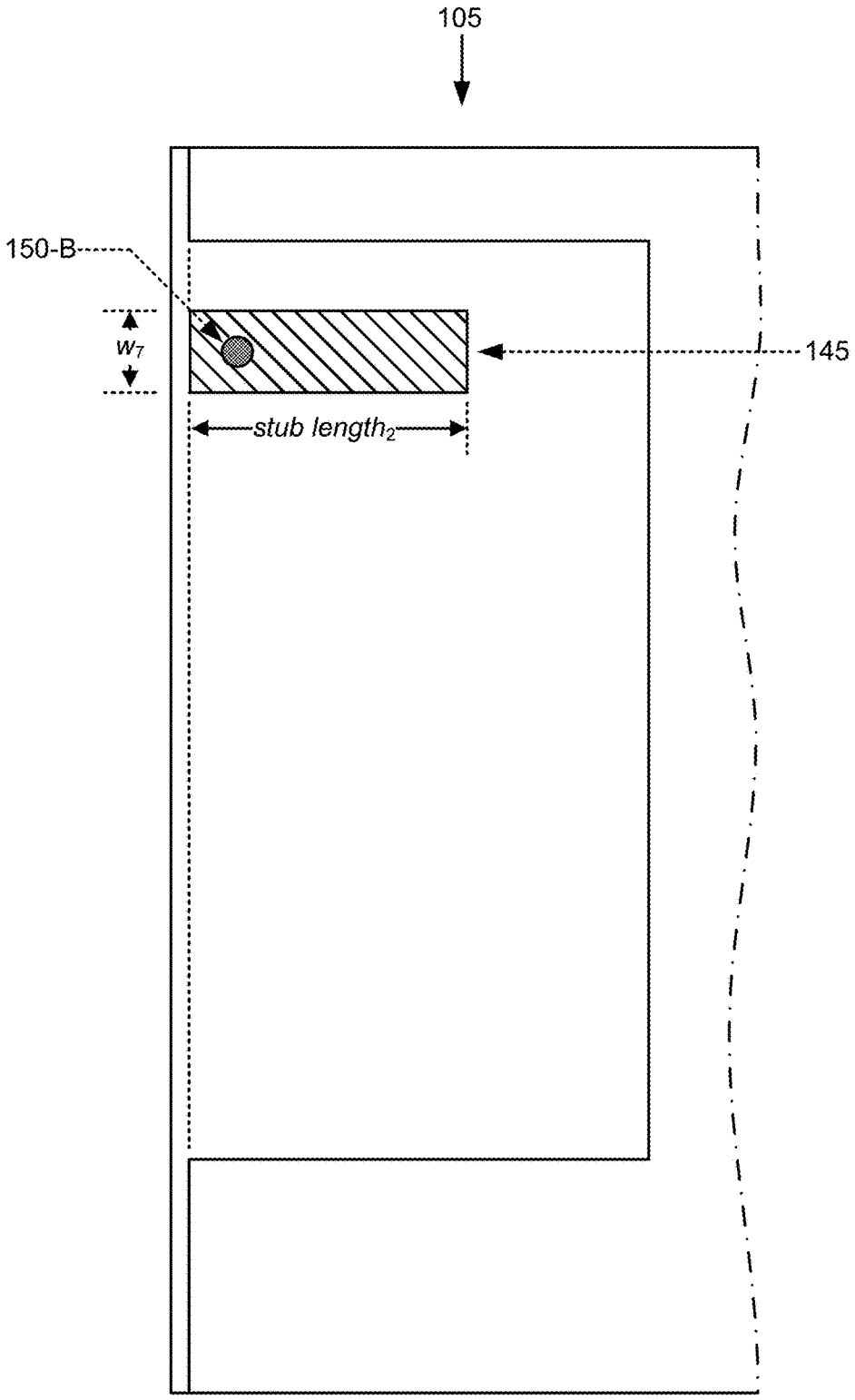

FIGS. 4-6 depict exemplary dimensional parameters associated with the various components of multi-layered PCB antenna 100. In one exemplary implementation, PCB antenna 100 may be used as a Bluetooth antenna having a resonant frequency of approximately 2.45 Gigahertz (GHz) and a bandwidth of at least 100 Megahertz (MHz). In other implementations, PCB antenna 100 may have different dimensional parameters than those described below with respect to FIGS. 4-6 for other, different wireless applications than Bluetooth.

FIG. 4 shows dimensional parameters of top layer 115 which, as described above, includes feed/ground conductive trace pattern 125 and, optionally, antenna tuning stub 135. The view of top layer 115 in FIG. 4 corresponds to a downward view (i.e., from the top of FIG. 1) from above top layer 115 in FIG. 1. In an implementation in which the antenna tuning stub is formed on top layer 115, instead of bottom layer 105, antenna tuning stub 135 may include a rectangular shape having a trace width ($w_1$) and a length (stub $length_1$). The rectangular shape of antenna tuning stub 135 may reside at an edge of the circuit board and extend inwards perpendicular to the circuit board edge. Width $w_1$ of antenna tuning stub 135 may range from about 0.5 mm to about 1.0 mm. In an exemplary implementation where multilayer PCB antenna 100 is used as a Bluetooth antenna, width $w_1$ of antenna tuning stub 135 may be 0.96 mm. The length, stub $length_1$, of antenna tuning stub 135 may range from about 2.0 mm to about 3.5 mm. In an exemplary implementation where multilayer PCB antenna 100 is used as a Bluetooth antenna, stub $length_1$ may be 2.98 mm. Via 150-T may have a diameter approximately one half of width $w_1$, and may be located at a location upon antenna tuning stub 135 to align precisely with via 150-I of antenna radiator trace 140 of intermediate layer 110. As further shown in FIG. 4, antenna tuning stub 135 may be located an offset distance ($offset_1$) from a pad 400 of feed/ground trace 125, wherein $offset_1$ may range from about 10.0 mm to about 12.0 mm. In an exemplary implementation where multilayer PCB antenna 100 is used as a Bluetooth antenna, $offset_1$ may be 10.8 mm.

As also shown, pad 400 of conductive trace pattern 125 may include a rectangular shape that has a width $w_2$, and a length $l_3$ that extends perpendicularly inwards from the edge of the circuit board to connect with antenna ground trace 127 and antenna feed trace 130. $w_2$ may range from about 0.8 mm to about 1.2 mm, and $l_3$ may range from about 1.6 mm to about 2.0 mm. In an exemplary implementation where multilayer PCB antenna 100 is used as a Bluetooth antenna, $w_2$ may equal 1.0 mm and $l_3$ may equal 1.76 mm. Via 155-T may have a diameter approximately one half of width $w_2$, and may be located at a location upon pad 400 to align precisely with via 155-I of antenna radiator trace 140 of intermediate layer 110.

Antenna ground trace 127 and antenna feed trace 130 include, together, an L-shaped conductive trace pattern, with the "base" of the L shape having a length $l_5$ and a width $w_6$, and the "leg" of the L shape having a width $w_4$. $l_5$ may range from about 3.0 mm to about 3.6 mm, $w_6$ may range from about 0.8 mm to about 1.2 mm, and $w_4$ may range from about 1.3 mm to about 1.6 mm. In an exemplary implementation where multilayer PCB antenna 100 is used as a Bluetooth antenna, $l_5$ may equal 3.36 mm, $w_6$ may equal 1.0 mm, and $w_4$ may equal 1.5 mm.

FIG. 5 shows dimensional parameters of intermediate layer 110 which, as described above, includes antenna radiator 140. The view of intermediate layer 110 in FIG. 5 corresponds to a downward view (i.e., from the top of FIG. 1) from above top layer 115 in FIG. 1. Antenna radiator 140 may include a rectangular shape having an antenna trace width ($w_A$) and an antenna length (L) that runs along an edge of the printed circuit board. The antenna trace width $w_A$ may range from about 0.8 mm to about 1.2 mm, and the antenna length L may range from about 12.0 mm to about 13.3 mm. In an exemplary implementation where multilayer PCB antenna 100 is a Bluetooth antenna, antenna trace width $w_A$ may equal 1.0 mm and antenna length L may equal 12.95 mm. Vias 150-I and 155-I may each have a diameter approximately one half of antenna trace width $w_A$, and may be located at appropriate locations at each end of antenna radiator 140 to align precisely with respective vias 150-T and 155-T of top layer 115.

FIG. 6 shows dimensional parameters of bottom layer 105 which, as described above, includes antenna tuning stub 145 in an optional implementation in which the antenna tuning stub is formed on bottom layer 105, instead of top layer 115. The view of bottom layer 105 in FIG. 6 corresponds to an upwards view (i.e., from the bottom of FIG. 1) from below bottom layer 105 in FIG. 1. Antenna tuning stub 145 may include a rectangular shape having a trace width ($w_7$) and a length (stub $length_2$). The rectangular shape of antenna tuning stub 145 may reside at an edge of the circuit board and extend inwards perpendicular to the circuit board edge. Width $w_7$ of antenna tuning stub 145 may range from about 0.5 mm to about 1.0 mm. In an exemplary implementation where multilayer PCB antenna 100 is used as a Bluetooth antenna, width $w_7$ of antenna tuning stub 145 may be 0.96 mm. The length, stub $length_2$, of antenna tuning stub 145 may range from about 2.0 mm to about 3.5 mm. In the exemplary implementation where multilayer PCB antenna 100 is used as a Bluetooth antenna, stub $length_2$ may be 2.98 mm. Via 150-B may have a diameter approximately one half of width $w_7$, and may be located at a location upon antenna tuning stub 145 to align precisely with via 150-I of antenna radiator trace 140 of intermediate layer 110.

Figure 7:
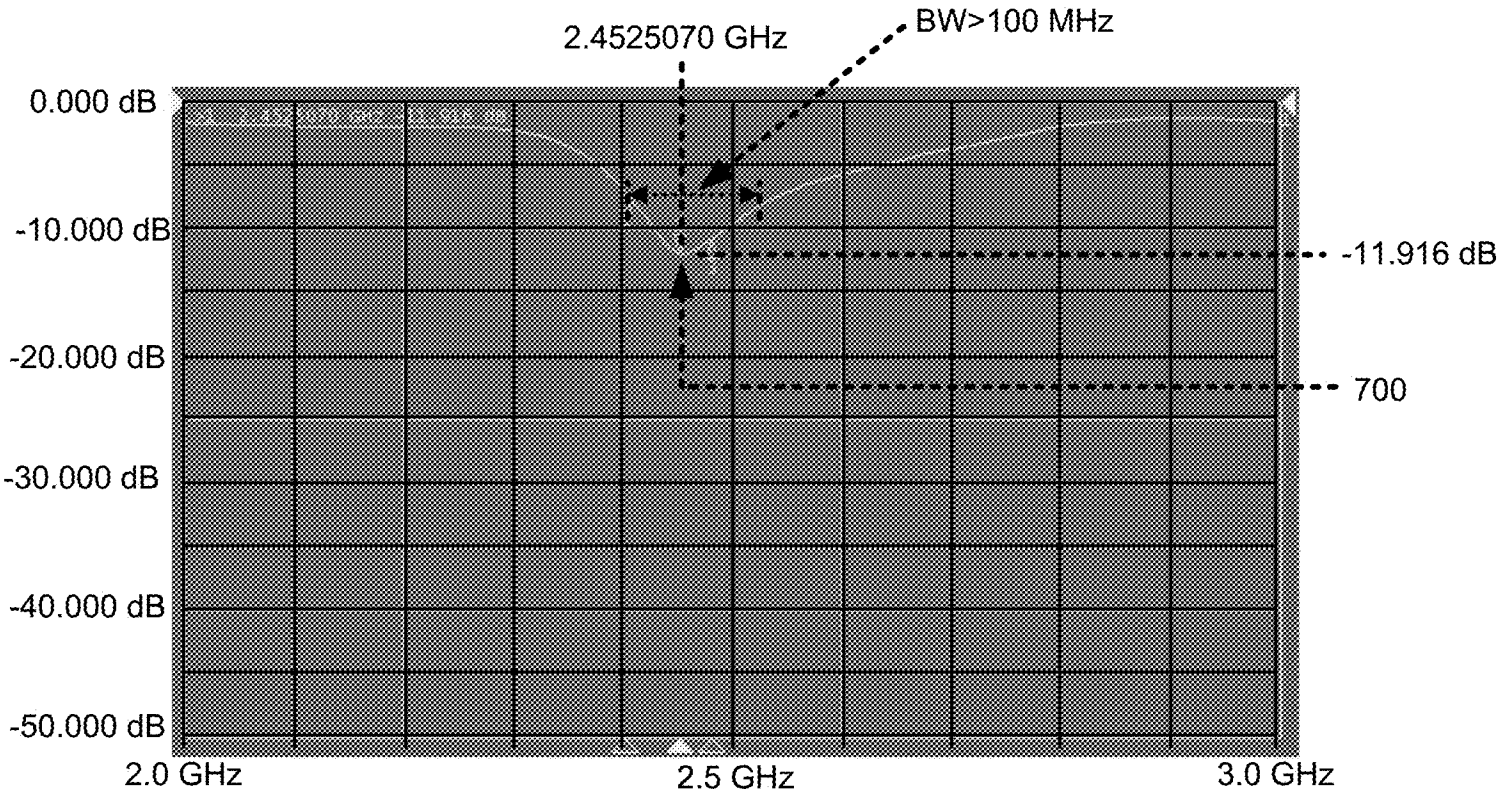
FIG. 7 depicts a tuning plot of the PCB antenna of FIG. 1 according to an exemplary implementation in which the antenna is a Bluetooth antenna.

FIG. 7 depicts a tuning plot of multilayer PCB antenna 100 in the exemplary implementation in which antenna 100 is a Bluetooth antenna. As seen in FIG. 7, the tuning plot covers a frequency range of 2.0 GHz to 3.0 GHz with a resonant frequency 700 of PCB antenna 100 occurring at 2.4525070 GHz. As can further be seen from FIG. 7, PCB antenna 100 has a bandwidth, at the resonant frequency 700, greater than 100 MHz.

Figure 8:
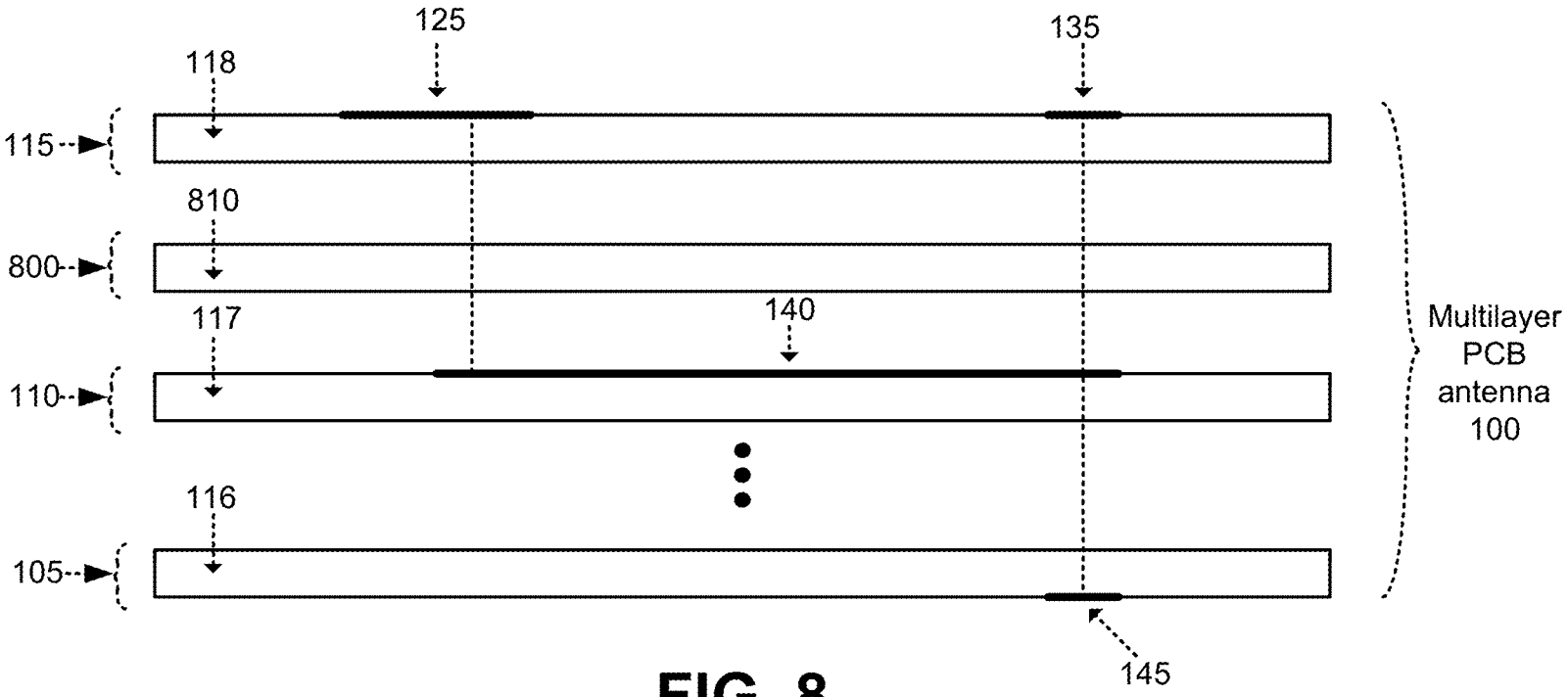
FIG. 8 depicts a further implementation of the multilayer PCB antenna of FIG. 1 in which additional intermediate layers are contained within the PCB antenna between the top layer and the intermediate layer, or between the intermediate layer and the bottom layer.

FIG. 8 depicts a further implementation of multilayer PCB antenna 100 in which additional intermediate layers are contained within PCB antenna 100 between top layer 115 and intermediate layer 110, and/or between intermediate layer 110 and bottom layer 105. FIG. 8 shows an additional intermediate layer 800, formed from a substrate 810, affixed between top layer 115 and intermediate layer 110, with electrical connections between feed/ground trace 125 and antenna radiator 140, and between antenna tuning stub 135 and antenna radiator 140, running through substrate 810 of intermediate layer 800. An additional intermediate layer(s), not shown in FIG. 8, may be affixed between intermediate layer 110 and bottom layer 105. If the additional intermediate layer(s) is affixed between layers 110 and 105, an electrical connection may be formed between antenna radiator 140 and antenna tuning stub trace 145 through the substrate of the additional intermediate layer(s).

The foregoing description of implementations provides illustration and description, but is not intended to be exhaustive or to limit the invention to the precise form disclosed. Modifications and variations are possible in light of the above teachings or may be acquired from practice of the invention. For example, various antenna patterns have been shown and various exemplary dimensions have been provided. It should be understood that different patterns and/or dimensions may be used than those described herein. Various dimensions associated with the substrate layers (e.g., substrate layers 116, 117, 118) have been provided herein, such as, for example, thicknesses of the substrate layers. It should be understood that different dimensions of the substrate layers, such as different thicknesses, may be used than those described herein. For example, for thickness dimensions described as encompassing an exemplary range of values, substrate layer thicknesses outside of those layers may be used, such as thicknesses greater than that described in the exemplary range of values. In each case, the antenna radiator may be embedded within, or located between, one or more dielectrics layers (e.g., PCBs) to effectively reduce the dimensions of the radiator as compared to conventional antennas. Some implementations have been described herein as using three substrate layers for the various conductive trace patterns of the PCB antenna. In other implementations, other numbers of substrate layers (e.g., 2, 4, 5 or 6 substrate layers) may be used for multilayer PCB antenna 100. Antenna radiator 140 is described herein (e.g., with respect to FIG. 1 and FIGS. 2A-2C) as formed on an upper surface of substrate layer 117, with antenna feed/ground trace 125 being formed on an upper surface of an adjacent substrate layer 118. However, other implementations may include antenna radiator 140 formed on a lower surface of substrate layer 117, or on an upper or lower surface of yet another substrate layer (not shown in FIG. 1) disposed between layer 110 and layer 105 in FIG. 1. In such implementations, a via(s) through the substrate layer(s) may connect antenna radiator 140 with antenna feed/ground trace 125 regardless of which side of the substrate layer antenna radiator 140 is formed upon.

In an exemplary embodiment, the tuning stub may be on one side of a given first substrate layer, where the tuning stub material is exposed to air, and the antenna radiator may be on the opposite side of the first substrate. In such an embodiment, another, second substrate layer side may be formed against the radiator side of the first substrate layer. Thus, the radiator is effectively encased, embedded, and/or sandwiched between, or otherwise surrounded by, dielectric material with one or more tuning stubs on a side of either the first or second substrate to expose the stub to enable tuning of the antenna. The feed/ground from the radiator may be formed on either side of the second substrate, or may be formed on the same side of the first substrate as the radiator.

In another exemplary embodiment, the thickness of the substrate that surrounds the antenna radiator may vary. For example, a first thickness of substrate may intervene between the radiator and air on one side of the radiator formed on a substrate layer, and a second thickness of dielectric material may intervene between the radiator and air on a second side of the radiator formed on the substrate layer. This may be accomplished by varying thicknesses of an equal number of layers on either side of the radiator, or by constructing different numbers of similar-thickness substrate/dielectric layers on opposite sides of the radiator. Regardless of the thicknesses, or number of layers that surround, or embed within, the radiator, a tuning stub is preferably constructed on an exterior side of an outermost substrate so that the conductive material of the stub is exposed to enable tuning of the antenna.

Certain features described above may be implemented as "logic" or a "unit" that performs one or more functions. This logic or unit may include hardware, such as one or more processors, microprocessors, application specific integrated circuits, or field programmable gate arrays, software, or a combination of hardware and software.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A printed circuit board (PCB) antenna, comprising:

a first PCB layer comprising:

a first PCB substrate, a first conductive pattern formed on the first PCB substrate, wherein the first conductive pattern comprises an antenna radiator, having an antenna length and a first and a second end; and a second PCB layer directly affixed to a first side of the first PCB layer, the second PCB layer comprising:

a second PCB substrate, a second conductive pattern formed on the second PCB substrate, wherein the second conductive pattern comprises an antenna ground connection, and an antenna feed connection, a first via through the second PCB substrate, wherein the first via connects the antenna ground connection and the antenna feed connection to the first end of the antenna radiator of the first PCB layer, and a third conductive pattern and a second via formed on the second PCB substrate, wherein the third conductive pattern comprises an antenna tuning stub, and the second via connects the antenna tuning stub to the second end of the antenna radiator of the first PCB layer.

2. The PCB antenna of claim 1, wherein the third conductive pattern comprises a rectangular shape that has a tuning stub length and a width.

3. The PCB antenna of claim 1, wherein the second PCB layer is affixed to the first side of the first PCB layer such that the first and second PCB layers are adjacent to one another and extend parallel to one another.

4. The PCB antenna of claim 1, wherein the first PCB layer further comprises a third via through the first PCB substrate, and further comprising:

a third PCB layer affixed to a second side of the first PCB layer, comprising:

a third PCB substrate, a fourth conductive pattern formed on the third PCB substrate, wherein the fourth conductive pattern comprises an antenna tuning stub, and a fourth via that connects to the second end of the antenna radiator through the third via of the first PCB layer.

5. The PCB antenna of claim 4, wherein the fourth conductive pattern comprises a rectangular shape that has a tuning stub length and a width.

6. The PCB antenna of claim 4, wherein the second PCB layer is affixed to the first side of the first PCB layer such that the first and second PCB layers are adjacent to one another and extend parallel to one another, and wherein the third PCB layer is affixed to a second side of the first PCB layer such that the first and third PCB layers are adjacent to one another and extend parallel to one another.

7. The PCB antenna of claim 1, wherein the first conductive pattern comprises a rectangular shape having a width and a length, wherein the length comprises the antenna length.

8. The PCB antenna of claim 1, wherein the first PCB substrate and the second PCB substrate comprise fiberglass, plastic, epoxy, or phenolics.

9. A multi-layered printed circuit board (PCB) antenna, comprising:

a lower PCB layer comprising a first antenna tuning stub trace formed on, or within, a first PCB substrate;

a first intermediate PCB layer comprising an antenna radiator trace formed on, or within, a second PCB substrate that is different than the first PCB substrate, wherein the antenna radiator trace connects to the first antenna tuning stub trace by at least one via through the second PCB substrate; and an upper PCB layer, directly affixed to the first intermediate PCB layer, comprising an antenna ground trace and an antenna feed trace formed on, or within, a third PCB substrate that is different than the first and second PCB substrates, wherein the antenna ground trace and the antenna feed trace connect to the antenna radiator trace by at least one via through the third PCB substrate.

10. The multi-layered PCB antenna of claim 9, wherein the antenna radiator trace has a rectangular shape with a length and width, wherein the length comprises the antenna length.

11. The multi-layered PCB antenna of claim 9, wherein the first antenna tuning stub trace comprises a rectangular shape that has a length and a width, wherein the length comprises the tuning stub trace length.

12. The PCB antenna of claim 9, wherein the upper PCB layer is affixed to the first intermediate PCB layer and wherein the first intermediate PCB layer is affixed to the lower PCB layer.

13. The PCB antenna of claim 9, wherein the upper PCB layer further comprises a second antenna tuning stub trace formed on the third PCB substrate.

14. The PCB antenna of claim 9, further comprising:

a second intermediate PCB layer comprising a fourth PCB substrate that is different than the first, second and third PCB substrates, wherein the second intermediate PCB layer is affixed to the lower PCB layer, and wherein the first intermediate PCB layer is affixed to the second intermediate PCB layer.

15. The PCB antenna of claim 9, further comprising:

a second intermediate PCB layer comprising a fourth PCB substrate that is different than the first, second and third PCB substrates, wherein the second intermediate PCB layer is affixed to the first intermediate PCB layer, and wherein the lower PCB layer is affixed to the second intermediate PCB layer.

16. A multi-layered printed circuit board (PCB) antenna, comprising:

a first PCB layer comprising:

an antenna radiator trace formed on, or within, a first PCB substrate, a first via that connects to a first end of the antenna radiator trace and extends through the first PCB substrate, and a second via that connects to a second end of the antenna radiator trace and extends through the first PCB substrate; and a second PCB layer, directly affixed to the first PCB layer, comprising:

an antenna ground trace, an antenna feed trace, and an antenna tuning stub formed on, or within, a second PCB substrate that is different than the first PCB substrate, wherein the antenna ground trace and the antenna feed trace connect to the antenna radiator trace by the first via through the first PCB substrate, and wherein the antenna tuning stub connects to the antenna radiator trace by the second via through the first PCB substrate.

17. The multi-layered PCB antenna of claim 16, wherein the second PCB layer is affixed to the first PCB layer such that the first and second PCB layers are adjacent to one another and extend parallel to one another.

18. The multi-layered PCB antenna of claim 16, wherein the antenna radiator trace has a length and a width, wherein the length comprises the antenna length.

19. The multi-layered PCB antenna of claim 16, wherein the antenna tuning stub has a length and a width, wherein the length comprises the tuning stub length.

20. The multi-layered PCB antenna of claim 16, wherein the first PCB substrate and the second PCB substrate comprise fiberglass, plastic, epoxy, or phenolics.

* * * * *